US005759355A

United States Patent [19]

Hirsimäki

[11] Patent Number: 5,759,355

[45] Date of Patent: Jun. 2, 1998

[54] PRESS SECTION IN A PAPER MACHINE

[75] Inventor: Martti Hirsimäki, Jyskä , Finland

[73] Assignee: Valmet Corporation, Helsinki, Finland

[21] Appl. No.: 673,276

[22] Filed: Jun. 28, 1996

[30] Foreign Application Priority Data

Jun. 30, 1995 [FI] Finland ..... 953245

[51] Int. Cl.[6] ..... D21F 3/04

[52] U.S. Cl. ..... 162/360.3; 162/358.3

[58] Field of Search ..... 162/358.1, 358.3, 162/359.1, 360.2, 360.3

[56] References Cited

U.S. PATENT DOCUMENTS

| | | | |
|---|---|---|---|
| 3,718,959 | 3/1973 | Vailas | 29/121 H |
| 4,483,745 | 11/1984 | Wicks et al. | 162/360.2 |
| 4,484,982 | 11/1984 | Majaniemi | 162/358 |
| 4,767,501 | 8/1988 | Laapotti | 162/358.1 |
| 4,976,821 | 12/1990 | Laapotti | 162/360.2 |
| 5,091,056 | 2/1992 | Autio | 162/360.2 |
| 5,120,399 | 6/1992 | Filzen | 162/360.2 |
| 5,120,400 | 6/1992 | Laapotti | 162/360.3 |
| 5,468,349 | 11/1995 | Schiel | 162/358.3 |

FOREIGN PATENT DOCUMENTS

| | | | |
|---|---|---|---|
| 1169284 | 6/1984 | Canada . | |
| 781426 | 11/1979 | Finland . | |
| 79731 | 6/1982 | Finland . | |
| 935501 | 8/1995 | Finland . | |
| 3604522 | 9/1986 | Germany | 162/358.3 |
| 4321406 | 11/1993 | Germany . | |
| 9508025 | 3/1995 | WIPO . | |

*Primary Examiner*—Karen M. Hastings
*Attorney, Agent, or Firm*—Steinberg, Raskin & Davidson, P.C.

[57] ABSTRACT

A press section in a paper machine including a first press nip formed between an upper roll and a lower roll whereby a paper web to be dewatered is passed through the first press nip on support of two press felts. The press section includes at least a second and a third press nip formed in connection with a smooth-faced center roll. A press felt is passed through the second and third press nips formed in connection with the center roll. The lower roll in the first nip is a metal-mantle lower roll which has a diameter substantially larger than the diameter of the upper roll in the first nip.

20 Claims, 4 Drawing Sheets

PRESS SECTION IN A PAPER MACHINE

FIELD OF THE INVENTION

The present invention relates to a press section in a paper machine which comprises a first press nip defined between an upper roll and a lower roll whereby a paper web to be dewatered is passed through the first press nip on support of two press felts. The press section also comprises at least a second and a third press nip both of which are defined in part by a single smooth-faced center roll whereby a press felt is passed through the second and third press nips defined in part by the center roll.

BACKGROUND OF THE INVENTION

One of the most important quality requirements of all paper and board grades is uniformity of the structure both in the micro scale and in the macro scale. The structure of paper, especially of printing paper, must also be symmetric. Good printing properties required from printing paper mean good smoothness, evenness and certain absorption properties of both faces of the paper. The properties of paper, in particular the symmetry of density, are affected to a considerable extent by the operation of the press section in the paper machine, which also has a decisive significance for the uniformity of several cross-direction and machine-direction profiles of the paper produced by the paper machine.

Increased running speeds of paper machines create new problems to be solved, which problems are mostly related to the runnability of the machine. Currently, running speeds up to about 1600 meters per minute are employed in paper machine. At these speeds, so-called closed press sections, which comprise a compact combination of press rolls arranged around a smooth-faced center roll, usually operate satisfactorily. As examples of such compact press sections, mention is made to the current assignee's "Sym-Press II" and "SymPress O" press sections (" " denotes a trademark). One object of the present invention to be discussed in greater detail below is further development of the first press nip in these press sections.

From the point of view of energy economy, dewatering of the web in the paper machine in the paper machine in general and in the press section in particular by pressing is preferable to dewatering of the web by evaporation. For this reason, attempts are made to remove as much water as possible out of the paper web by pressing in order that the proportion of the amount of water to be removed by evaporation can be as little as possible. Increased running speeds of paper machines, however, provide new, as yet unsolved problems expressly related to dewatering by pressing, in connection with which the problems of runnability are manifested with increased emphasis. This is because a web having a high water content and low strength does not endure an excessively high and abrupt impulse of compression pressure or the dynamic forces produced by high speeds at such running speeds, but rather web breaks and other disturbances in the operation arise, which result in standstills of the paper machine.

Recently, running speeds of paper machines as high as about 2000 meters per minute are being contemplated. The achievement of web running speeds as high as these, in particular with wide machines, provide ever more difficult problems to be solved, of which problems the most important ones are runnability of the machine and adequate dewatering capacity at high speeds.

As is well known in the art, in the first nip In the press section, a suction roll coated with a relatively soft coating has often been used as a back-up roll. It has been recognized though that at high web running speeds, the durability of the coating has proved problematic, in which case the coating is now usually omitted and a hard roll is used as the backup roll.

With intensive compression in the first nip of a press section in the running direction of the web, i.e., the first press nip after the forming section, a high, steep pressure pulse is produced, which may result in disintegration of the web having a high water content and low strength. Even though in the first nip, quite a low overall load is used, only about 60 kN/m to about 80 kN/m, this produces a relatively intensive compacting of the paper web, which is seen as a deterioration of the dewatering efficiencies in the subsequent press nips. Attempts have been made to solve this by increasing the load, but this has not increased the efficiency of dewatering but may, in extreme cases, even have lowered the efficiency of dewatering.

One specific problem encountered in the operability of a press section at high running speeds is the increased problems of conditioning of the press felts running through the press section. Even if these press felts operate well when they are new, with ageing, they may be blocked as a result of being compressed during operation and lose their draining capability.

With respect to the prior art, reference is made to the current assignee's Finnish Patent Application No. 935501 (which corresponds to U.S. patent application Ser. No. 08/332,861), in which a press section of a paper machine is described in which an extended-nip press is employed. In the extended-nip press, an extended-nip roll is used and is provided with a belt-like mantle made, for example, of a polyurethane-based, fiber-reinforced belt. This construction is somewhat problematic because of the high loads applied to the suction roll. Further, this prior art arrangement cannot be applied readily in connection with renewals or modifications of existing press sections.

Also with respect to the prior art, reference is made to published German Patent Application No. DE 43 21 406 (which corresponds to U.S. Pat. No. 5,478,349 incorporated by reference herein) which describes a press section including an extended nip as the first nip. The publication WO 95/08025 describes a press section in which the first nip is an extended-nip press. The drawbacks of these prior art constructions are of the same type as those described in relation to Finnish Patent Application 935501 mentioned above.

From the prior art, large-roll presses are also known, which are composed of two large rolls. One such large-roll press is described in U.S. Pat. No. 4,484,982, incorporated by reference herein.

Also, from the prior art, press sections are known in which there is a steam box placed against a suction roll between the first and the second press nip.

The problems of the prior art press section constructions operating at high web running speeds are based on the fact that, when the dry solids content after the wire part is lowered at increasing speeds, the press must be capable of handling/removing more water. Since the durability of the coatings used on the rolls is limited, at high speeds hard coatings have been introduced, in which case the pressure pulse in the first press nip becomes sharp, i.e., it increases rapidly and has a fairly high peak pressure. For this reason, the dewatering process in the first press nip is violent, i.e., it involves high pressure gradients and flow velocities. This results in a risk of crushing, i.e., an increased probability that the couched web is disintegrated. Also, owing to this effect, a distribution of density is produced in the web, i.e., the surfaces of the web become intensively denser, which prevents efficient dewatering. Owing to an inadequate dewatering in the first and the second nip, at high speeds problems of runnability have arisen, i.e., web breaks have occurred in the areas of these nips. Attempts have been made to rectify this problem by means of thick felts which has unavoidably increased the problems of conditioning of such thick felts and moreover, the altered properties of the felt along with the use may cause problems.

OBJECTS AND SUMMARY OF THE INVENTION

Accordingly, it is an object of the present invention to create a press section of a paper machine in which the dewatering of the web in the first press nip in the press section in the running direction of the web takes place more softly and more slowly than in the prior art press section arrangements. In this case, the softer, slower dewatering is enabled by a lower and less steep pressure pulse.

It is a further object of the present invention to provide an arrangement of a press section in which the service life of the felts is increased and also to provide an arrangement of a press section that can be applied readily to existing press sections in connection with renewals or modifications thereof.

It is another object of the present invention to provide novel solutions for the problems discussed above so that the drawbacks mentioned above and drawbacks that will come out later and that are otherwise experienced in the prior art press sections, are substantially avoided.

It is still another object of the present invention to provide a method for removing water from the paper web by pressing at high running speeds, in particular at speeds higher than about 25 meters per second, whereby in the press section, the web is not subjected to excessively high dynamic forces that attempt to disintegrate the couched web.

It is yet another object of the present invention to provide a new and improved press section which achieves a higher dry solids content after the first nip (second nip).

In view of achieving the objects stated above and others, the press section in accordance with the present invention in a paper machine includes a first nip in the press section in the running direction defined by a metal-mantle lower roll and an opposed upper roll. The metal-mantle lower roll has a metallic roll mantle and a diameter substantially larger than the diameter of the upper roll.

According to the present invention, the problems in the prior art press sections have been overcome by, in the first nip in the press section, using such a large-diameter rigid metal-mantle lower roll, and by means of this arrangement it is achieved that in the nip the press pulse becomes less steep and less high, in comparison to the press pulse with the prior art press nip construction in the first nip in the press section when the same overall load is employed. In this manner, with an arrangement in accordance with the present invention, the dewatering process is slower and more gentle, in which case the risk of crushing the web is lower and the distribution of density is more even and uniform. If necessary, it is even possible to increase the load in the first nip in order to provide additional dewatering of the web. When an arrangement of the press section in accordance with the invention is employed, the dewatering is enhanced and a dry solids content that is about 1% to about 2% higher after the first nip is achieved. Thus, the runnability in the press section is improved.

It is obtained as a further advantage of the invention that the sensitivity to a lowering of, or changes in, the dry solids content after the wire section is lowered.

The invention also permits the use of soft coatings, which endure better in themselves. Further, the sensitivity in relation to the operation of the felts is reduced, in which case a softer nip even increases the service life of the felts.

According to the invention, as the backup roll in the first nip, a large-diameter, rigid metal-mantle tubular roll is used, which can also be a variable-crown roll. The cost of manufacture of this roll is favorable, and its construction is simple. The roll is preferably a coated roll, which is grooved and blind-drilled. The hardness of the coating is typically of an order of about 3 P&J to about 15 P&J. The roll may also be a grooved roll provided with a hard G-band. One of the most advantageous aspects thought is that a soft loading is produced in the first nip by means of this metal-mantle roll. This also provides the advantage that the coating on the backup roll is no longer loaded to the same extent as in the prior art constructions, in which case a coated roll is durable also in this position and even at high speeds.

The invention also provides a sufficiently cautious and gentle start of the dewatering, which is important in view of the fact that, at high speeds, also the water contents in the web after the former tend to become higher.

According to the invention, the shape of the pressure pulse in the first nip is changed so that it is less steep and longer and less high than in the prior art arrangements.

By means of the arrangement in accordance with the invention, it is achieved that, if necessary, the press nip can be loaded to a greater extent or, if desired, it is achieved that the web does not become denser to an equally great extent as in the prior art, in which case the dewatering in the subsequent nips is more efficient. Moreover, the service life of the press felts used in the press becomes longer.

Earlier, in the press sections of the types "Sym-Press II" and "Sym-Press 0", it was one important factor that equal backup rolls were used both in the first press and in the third press, in which case just one spare roll was needed. Recent development has, however, shown that the backup roll placed in the upper position can often be substituted for by an extended nip, in which case this spare roll significance is lost, so that the arrangement of the present invention does not result in any inconvenience in that respect either.

In a preferred embodiment of the invention, it is also possible to heat the web before the first press nip, whereby the viscosity of the water is lowered and, thus, the water draining capacity of the press is improved. The viscosity can also be lowered by the use of a suitable chemical, for example a chemical that contains long hydrocarbon molecule chains, as is suggested, e.g., in the so-called Pennyman process. The heating can be carried out, for example, in the following ways: the web is heated by means of a steam box before it enters between two felts (either in the wire part or against the pick-up felt); both the felt and the web are heated with steam; and the web is heated by contact with a heated large-diameter roll (e.g., drilled-mantle water circulation).

Instead of the steam boxes mentioned above, it is possible to use a gas or electric infrared heater.

In the present invention and in its different embodiments, it has been successfully possible, in a novel and inventive way, to combine certain component solutions, some of them in themselves known from the paper machine technology, so that the problems of different natures discussed above have been brought under control and solved by means of the novel overall concept.

In the method in accordance with the invention, a web is passed from a forming section onto a first felt in the press section, through a first press nip defined by an upper roll and a lower roll and then through second and third press nips arranged after the first press nip in a running direction of the web and defined in part by a smooth-faced center roll. The lower roll has a metallic mantle and a diameter substantially larger than the diameter of said upper roll and the first press nip is loaded, e.g., by crown-variation means, such that a gentle and long pressure pulse is provided in said first press nip as a result of the larger diameter of said lower roll relative to said upper roll.

In the following, the invention will be described in more detail with reference to the figures in the accompanying drawing. However, the invention is not strictly confined to the details of the illustrated embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
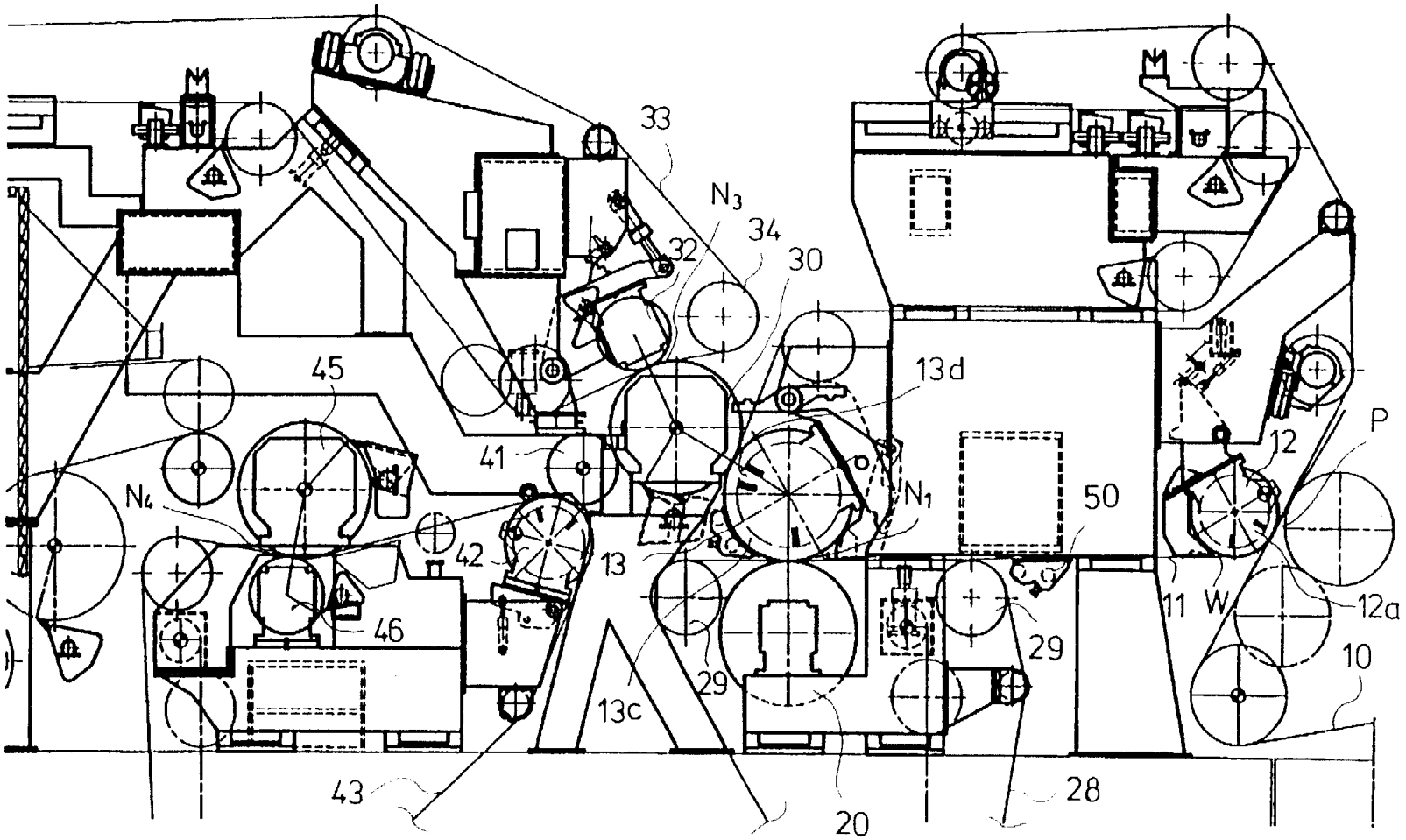
FIG. 1 is a schematic side view of a first exemplifying embodiment of the invention, which is based on a press section of the "Sym-Press II" type.

In the figures, the components most important from the point of view of the invention are denoted with reference numerals, and the frame constructions and auxiliary equipment in themselves known to a person skilled in the art and related to the press section and its environment are not provided with reference numerals. The frames of the press section are normal frames that permit quick felt and roll replacement.

Referring to the accompanying drawings wherein the same reference numerals refer to the same or similar elements, in the exemplifying embodiment of the invention shown in FIG. 1, a paper web W is separated from a forming wire 10 and transferred at a pick-up point P from the forming section onto a pick-up felt 11 aided by a suction zone 12*a* of a pick-up suction roll 12 arranged in a loop of the pick-up felt. The pick-up felt 11 operates as a water-receiving upper fabric in a first press nip $N_1$ into which the web W is transferred on the lower face of the felt 11. In the press nip N1, there is a water-receiving lower felt 28 which is guided in a loop by guide rolls 29. The lower press component in the first press nip $N_1$ is a large-diameter metal-mantle roll 20, and the upper press component is a suction roll 13 provided with a perforated mantle. In the interior of the mantle of the suction roll 13, there are two successively arranged suction zones 13*c* and 13*d*. A second press nip $N_2$ is formed or defined between the suction roll 13 and a smooth-faced center roll 30 arranged in opposed, nip-defining relationship thereto. The web is transferred from the upper felt 11 to the face of the center roll 30 in the second press nip $N_2$. A third press nip $N_3$ is formed between the center roll 30 and a roll 32, which is, for example, a variable-crown roll adjustable in zones.

After the third press nip $N_3$, the paper web W is transferred from the face of the center roll 30 over a lead roll 41 onto a press felt 43 running over a suction roll 42. The web W is passed on a top face of the felt 43 into a fourth press nip N4 which is formed by rolls 45 and 46 and from which the web W is passed further to a dryer section.

The upper felt 11 of the first nip $N_1$, which felt is also the pick-up felt, additionally operates as a water-receiving press felt in the second nip $N_2$, after which the web W follows the smooth face 31 of the center roll 30 and is separated from the upper felt 11. A water-receiving press felt 33 runs through the third nip $N_3$ and is guided in a loop by guide rolls 34.

Figure 1A:
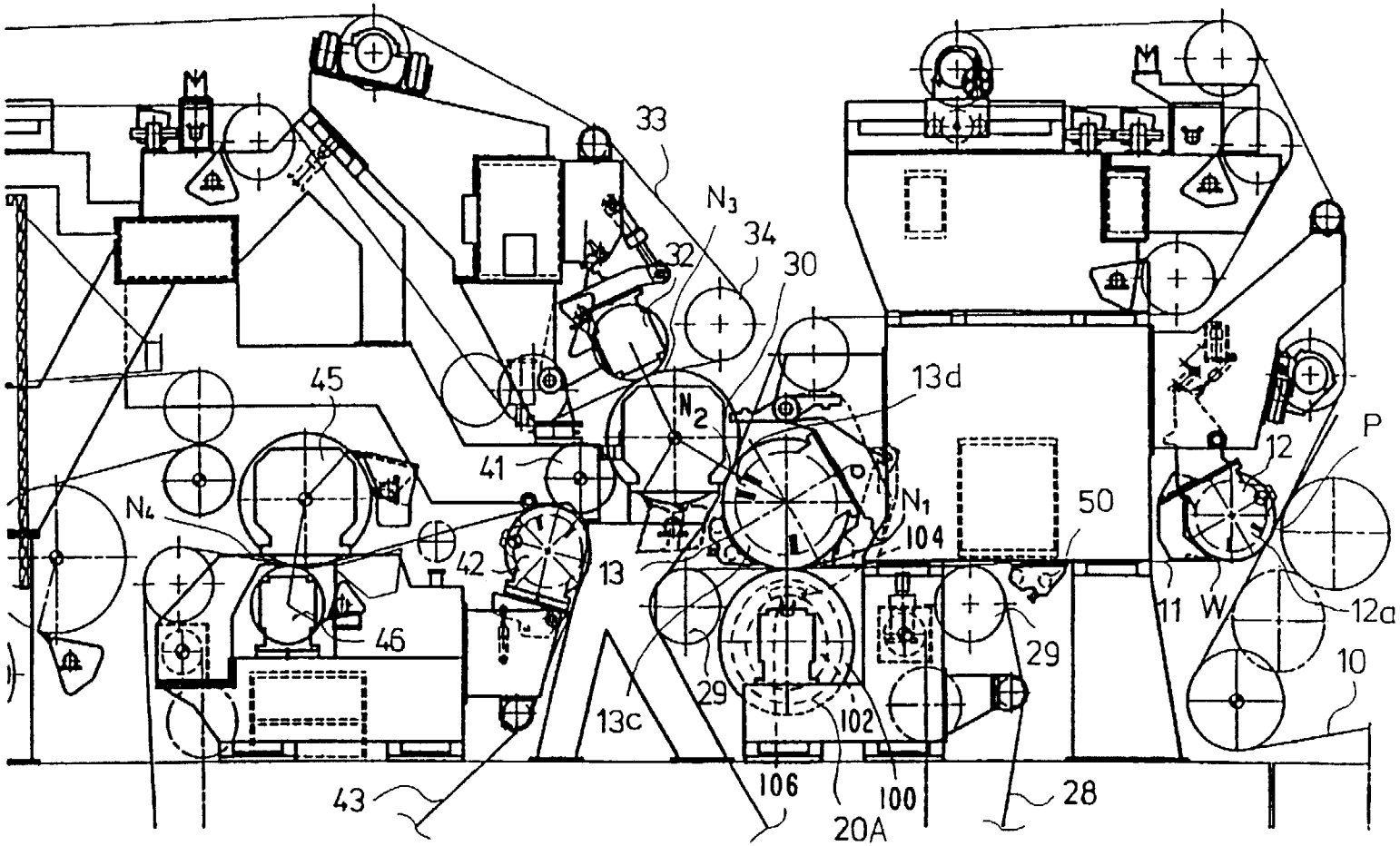
FIG. 1A is a schematic side view of an embodiment of the invention similar to that shown in FIG. 1 but in which the lower roll in the first press nip is a variable-crown roll.

The embodiment shown in FIG. 1A is similar to that shown in FIG. 1 except that the lower roll 20A in the first press nip $N_1$ is a variable crown roll including a roll mantle 100, a solid center core 102 having pressure chambers 106 and a loading shoe 104 arranged in each pressure chamber 106. As is conventional in the art, there are a plurality of pressure chambers 106 and associated loading shoes 104 along the axial length of the roll 20A. Means (not shown) are provided in the roll 20A to supply a pressure medium to the pressure chambers 106 to load the loading shoes 104 against the inner face of the roll mantle 100.

Figure 2:
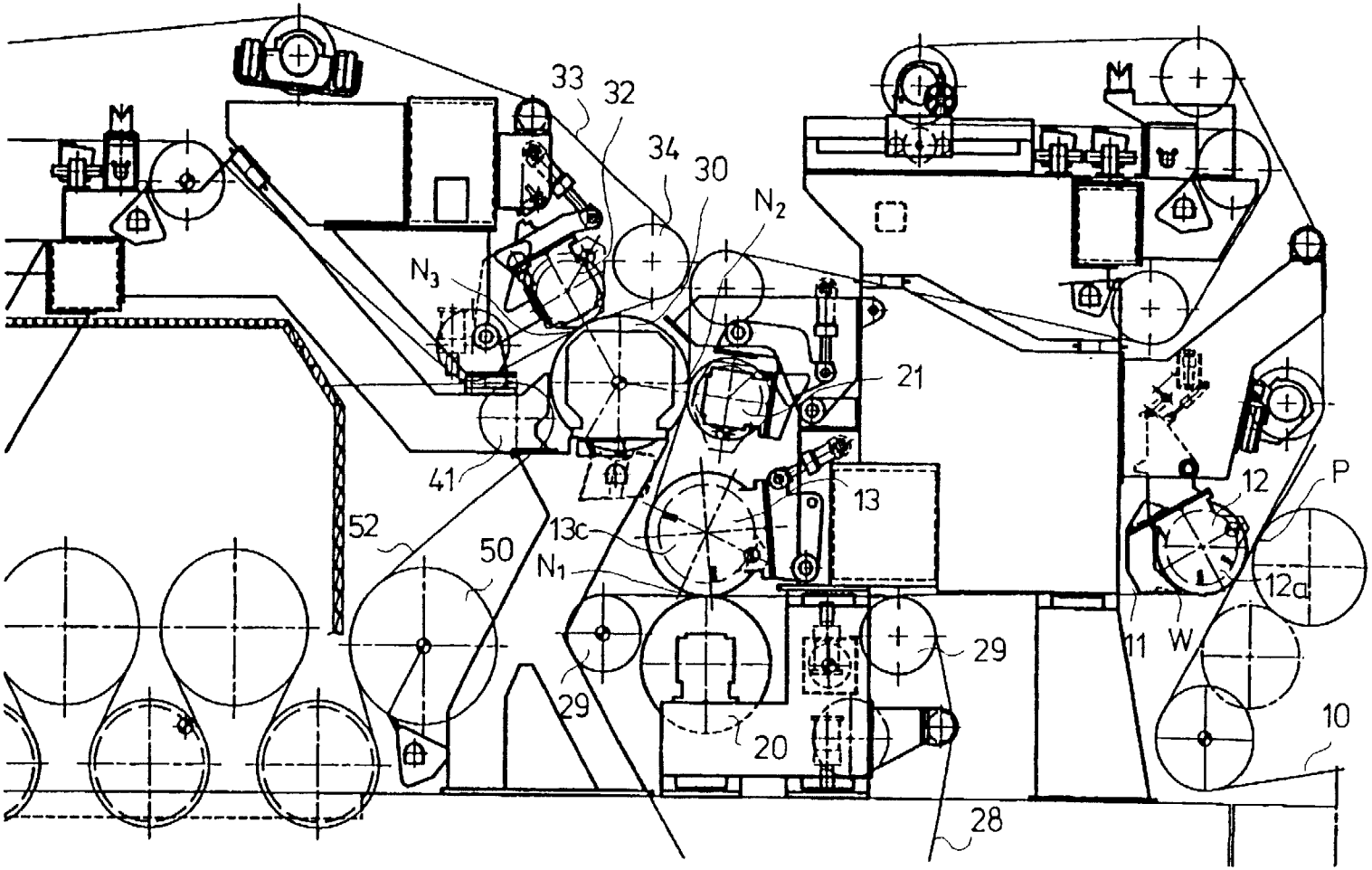
FIG. 2 is a schematic illustration of a second exemplifying embodiment of the invention, which is based on a press section of the "Sym-Press O" type.

In the exemplifying embodiment shown in FIG. 2, the paper web W is passed from the former section into the first press nip $N_1$ in a manner similar to the exemplifying embodiment shown in FIG. 1, and the same reference numerals denote corresponding parts. The web W is passed into the first press nip $N_1$ on the lower face of the upper felt 11, and the other fabric is a water-receiving lower felt 28 which is guided in a loop by guide rolls 29.

As shown in FIG. 2, the lower press component in the first press nip $N_1$ is a large-diameter metal-mantle roll 20, and the upper roll 13 is a suction roll provided with a perforated mantle. In the interior of the mantle of suction roll 13, there is a suction zone 13*c* placed facing the press zone of the nip $N_1$ and extends upwards so that it aids the changing of the running direction of the upper felt 11 and the web W transferred on the support of the felt from a substantially horizontal direction to a relatively steeply upwards inclined direction. By means of this substantially straight upward run, the web W is passed into the second press nip $N_2$ formed between the center roll 30 and the roll 21. Thus, in this embodiment the suction roll 13 does not form a nip with the center roll 30. Also, the third press nip $N_3$ is formed in connection with the center roll 30, between the center roll 30 and the roll 32, which is, for example, a variable-crown roll adjustable In zones.

The upper felt 11 operates as a water-receiving fabric also in the second nip $N_2$, after which the web W follows the smooth face 31 of the center roll 30 and is separated from the upper felt 11. Through the third nip $N_3$, a water-receiving press felt 33 runs and is guided in a loop by the guide rolls 34. After the third nip $N_3$, the web W is passed from the face of the center roll 30, being guided by the guide roll 41, onto a lower face of a drying wire 52 and is transferred further over a first drying cylinder 50 or an equivalent lead-in cylinder of the drying section. Thus, in most respects, the embodiment of FIG. 2 is similar to the embodiment of FIG. 1.

Figure 3:
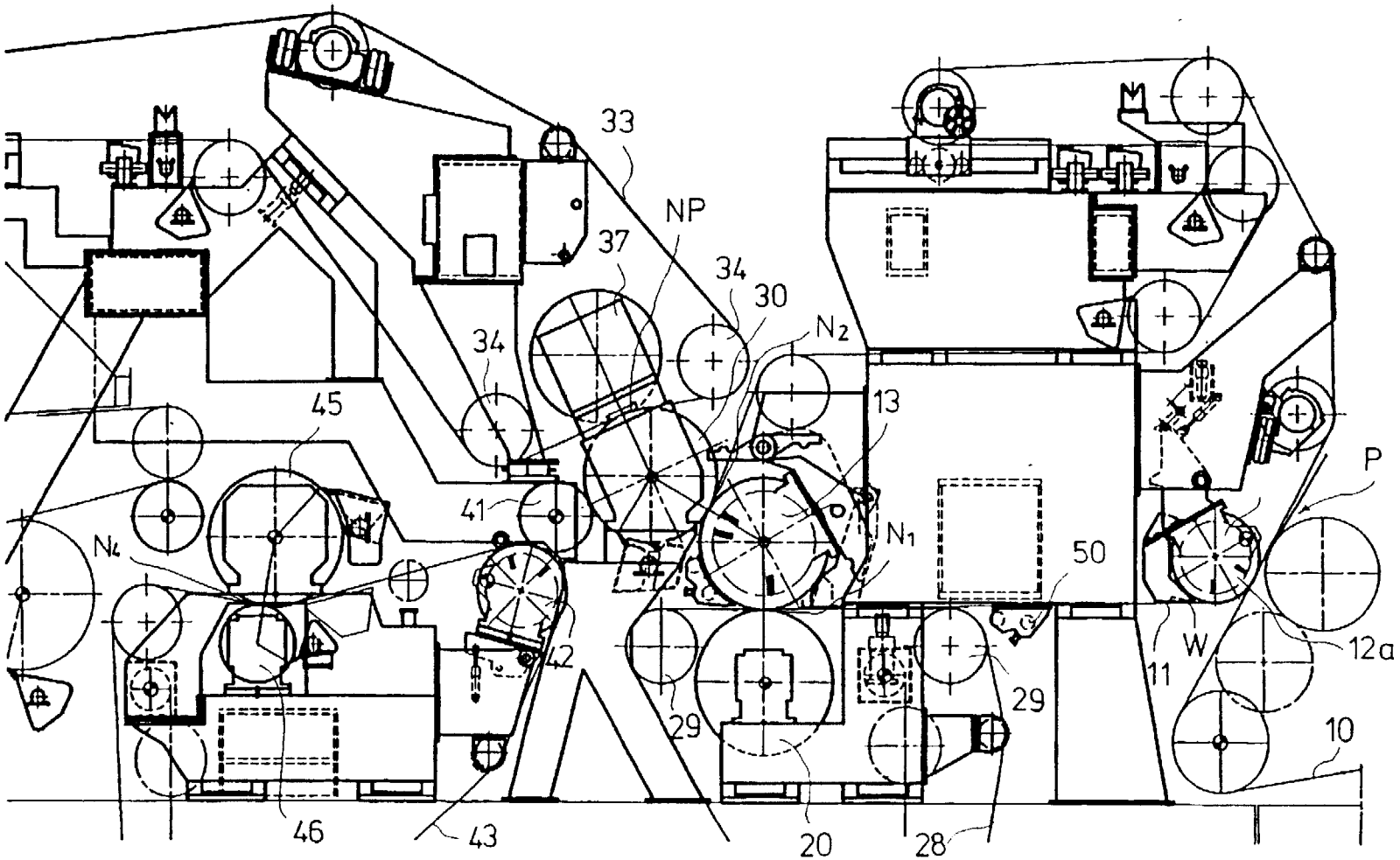
FIG. 3 is a schematic illustration of a third exemplifying embodiment of the invention, which is based on a press section of the "Sym-Press II" type and in which an extended-nip press is used as the third press nip.

The exemplifying embodiment of the invention shown in FIG. 3 is similar to the exemplifying embodiment shown in FIG. 1 with the exception of the third press nip, and corresponding parts are denoted with the same reference numerals, except that the third press nip NP is an extended-nip press in itself known from the prior art. In such as extended-nip press, in the upper position, a roll 37 provided with a flexible mantle and a press shoe situated inside the mantle is placed. The press shoe is loaded by means of hydraulic cylinders, and by regulating the pressures in the hydraulic cylinders it is possible to regulate the level of the compression pressure in the extended nip NP. In most other respects, the embodiment of FIG. 3 is similar to the embodiment of FIG. 1.

As comes out from the exemplifying embodiments illustrated in FIGS. 1–3, in the first press $N_1$ in the press section, as the back-up roll, i.e., most often the roll in the lower position, a metal-mantle roll 20 is used whose diameter of the roll 13 placed ally larger than the diameter of the roll 13 placed in the upper position. For example, the diameter of the roll 20 is in a machine having a width of 6 meters, from about 1200 mm to about 1600 mm, preferably from about 1300 mm to about 1500 mm, and in a machine having a width of 10 meters, the diameter is 1600 m to about 2000 mm, preferably from about 1800 mm to about 2000 mm. The diameter of the roll 13 is, for example, in a machine having a width of 6 meters about 1000 mm and in a machine of a width of 10 meters, about 1500 mm. The length of the nip is about 50 mm to about 80 mm, depending on the roll diameter, roll coating and on the felts that are used. The roll diameter, roll coating and felts can be selected to provide for a specific length of the nip.

According to the invention, the back-up roll 20 in the first nip $N_1$ is a roll 20 having a large diameter and rigid construction, and it can also be a variable-crown roll. Preferably, the roll 20 is a coated roll which is provided with grooves and blind-drilled. The hardness of the coating is typically of an order of from about 3 P&J to about 15 P&J. The roll 20 may also be a grooved roll provided with a G-band. A G-band or a G-coating is described in U.S. Pat. No. 3,718,959, incorporated by reference herein, and a brochure "Valmet G-Covers and G-Rolls" published by the current assignee. Briefly, a G-band may be a winding of a stainless steel strip around a roll such that multiple thin grooves are formed closely spaced on the roll surface and provide a continuous open flow path for the removal of water from the press nip.

It is important that a soft loading is provided in the first nip $N_1$, i.e., that the loading pressure pulse is low and gently rising, in which case, in the first nip press $N_1$, even at high web speeds, the web W is subjected to a sufficiently slow and gentle dewatering. When the web W enters into the nip $N_1$, its dry solids content is typically in a range of about 13% to about 18%, and immediately after the nip $N_1$, the dry solids content of the web W is generally in a range of about 25% to about 28%. The proportion of the dewatering taking place in the nip out of the total dewatering taking place in the press section is typically in a range of from about 50% to about 70%, which can be provided by suitable dimensioning of the parameters which affect dewatering in the nip, i.e., the roll diameter, roll coating, felts and nip loading.

In the following, the widest and the preferable ranges of variation of the loads in the different nips in a press section in accordance with the present invention will be given. It should be understood that the invention is in no way limited to these ranges of variation.

First nip $N_1$=about 70 kN/m to about 90 kN/m, preferably about 90 kN/m.

Second nip $N_2$=about 80 kN/m to about 90 kN/m, preferably about 90 kN/m.

Third nip $N_3$=about 130 kN/m to about 140 kN/m, preferably about 140 kN/m.

Furthermore, as shown in FIGS. 1–3, in connection with the arrangement in accordance with the invention, it is possible to heat the web W before the first nip $N_1$ by means of a heating device 50. Heating of the web at this specific location lowers the viscosity of the water and thus promotes the operation of the first press nip. The heating can be carried out, for example, so that the web W is heated by means of a steam box 50 before the web enters into its run between two felts 11,28 (FIG. 1), either in the wire part or against the pick-up felt. The heating can also be carried out so that both the felt and the web are heated. Also, the heating device 50 may be a gas or electric infrared heater.

The examples provided above are not meant to be exclusive. Many other variations of the present invention would be obvious to those skilled in the art, and are contemplated to be within the scope of the appended claims.

I claim:

1. A press section in a paper machine for pressing a web, comprising an upper roll and a lower roll defining a first press nip in a running direction of the web through the press section, said lower roll comprising a metallic roll mantle and having a diameter larger than a diameter of said upper roll structured and arranged to provide a gentle and long pressure pulse in said first press nip, said upper roll being a suction roll having a suction zone at said first press nip, first and second press felts for supporting and guiding the web through said first press nip, means defining a second press nip arranged after said first press nip in the running direction of the web, and means defining a third press nip arranged after said second press nip in the running direction of the web, said means defining said second press nip and said means defining said third press nip comprising a smooth-faced center roll which defines in part said second and third press nips, a press felt being passed through each of said second and third press nips.

2. The press section of claim 1, wherein the diameter of said lower roll in said first press nip is from about 1200 mm to about 1600 mm and the diameter of said suction roll is about 1000 mm.

3. The press section of claim 1, wherein the diameter of said lower roll in said first press nip is from about 1600 mm to about 2000 mm and the diameter of said suction roll is about 1500 mm.

4. The press section of claim 1, wherein said metallic mantle of said lower roll is rigid and tubular.

5. The press section of claim 1, wherein said lower roll further comprises crown-variation means arranged in an interior of said roll mantle and operative against an inner face of said roll mantle.

6. The press section of claim 4, wherein said lower roll further comprises a coating having a hardness of from about 3 P&J to about 15 P&J.

7. The press section of claim 6, wherein said metallic mantle of said lower roll is grooved and/or blind-drilled.

8. The press section of claim 4, wherein said metallic mantle of said lower roll is grooved and provided with a G-coating.

9. The press section of claim 1, further comprising heating means arranged after the web is received on at least one of said first and second felts for heating the web before said first nip.

10. The press section of claim 9, wherein said heating means comprise an electric or gas infrared heater.

11. The press section of claim 9, wherein said heating means comprise a steam box arranged after the web is received on only one of said first and second fabrics and to direct steam at an exposed face of the web.

12. The press section of claim 1, wherein said means defining said third press nip further comprise an extended nip roll arranged to define said third press nip with said center roll.

13. The press section of claim 1, further comprising means defining a fourth press nip arranged after said third press nip in the running direction of the web and after the web has separated from a face of said center roll.

14. The press section of claim 1, wherein said upper roll in said first press nip is arranged in nip-defining relationship with said center roll to thereby define said second press nip, said first press felt constituting the press felt passing through said second press nip.

15. The press section of claim 1, wherein the diameter of said lower roll of said first press nip is selected relative to the diameter of said upper roll to provide a length of said first press nip from about 50 mm to about 80 mm.

16. The press section of claim 1, wherein said first press nip is arranged after a forming section preceding the press section without the interposition of a press nip between an end of the forming section and said first press nip.

17. The press section of claim 1, wherein the diameter of said lower roll of said first press nip, a coating applied to said lower roll and said first and second press felts are selected relative to one another to provide a length of said first press nip from about 50 mm to about 80 mm.

18. A method for dewatering a web in a press section, comprising the steps of:

passing a web from a forming section onto a first felt in the press section, passing the web through a first press nip defined by an upper roll and a lower roll, said lower roll having a metallic mantle and a diameter larger than the diameter of said upper roll, said upper roll being a suction roll having a suction zone at said first press nip, passing the web through second and third press nips arranged after said first press nip in a running direction of the web and defined in part by a smooth-faced center roll, and loading the first press nip such that a gentle and long pressure pulse is provided in said first press nip as a result of the larger diameter of said lower roll relative to said upper roll.

19. The method of claim 18, further comprising the step of arranging crown-variation means in an interior of said lower roll to load said first press nip.

20. A press section in a paper machine for pressing a web, comprising an upper roll and a lower roll defining a first press nip in a running direction of the web through the press section, said lower roll comprising a metallic roll mantle and having a diameter larger than a diameter of said upper roll structured and arranged to provide a gentle and long pressure pulse in said first press nip, said upper roll being a suction roll having a suction zone at said first press nip, first and second press felts for supporting and guiding the web through said first press nip, means defining a second press nip arranged after said first press nip in the running direction of the web, means defining a extended nip arranged after said second press nip in the running direction of the web, said means defining said second press nip and said means defining said extended nip comprising a smooth-faced center roll which defines in part said second nip and said extended nip, and a press felt arranged to pass through said second press nip and said extended nip, said means defining said extended-nip further comprising an extended nip press member arranged to define said extended nip with said center roll, said extended nip press member comprising a flexible mantle defining an interior space, a press shoe arranged in said interior space and loading means operatively associated with said press shoe for loading said press shoe to thereby provide compression pressure in said extended nip.

* * * * *